US005458042A

United States Patent [19]

Cante

[11] Patent Number: 5,458,042

[45] Date of Patent: Oct. 17, 1995

[54] CONTAINER FOR PACKAGING AN OBJECT PROVIDED WITH A RADIO FREQUENCY TRANSMISSION DEVICE AND REMOVABLE ELEMENT FOR SUCH A CONTAINER

[75] Inventor: Philippe Cante, Gif sur Yvette, France

[73] Assignee: Aerospatiale Societe Nationale Industrielle, Paris, France

[21] Appl. No.: 300,634

[22] Filed: Sep. 2, 1994

[30] Foreign Application Priority Data

Sep. 6, 1993 [FR] France ..... 93 10556

[51] Int. Cl.[6] ..... F41F 3/042; F41F 3/055

[52] U.S. Cl. ..... 89/6.5; 89/1.813

[58] Field of Search ..... 89/6.5, 6, 1.816, 89/30, 1.813

[56] References Cited

U.S. PATENT DOCUMENTS

| | | | |
|---|---|---|---|
| 3,371,579 | 3/1968 | Kinzelman | 89/6 |
| 4,137,819 | 2/1979 | Loomis, III | 89/1.813 |
| 4,307,665 | 12/1981 | Block et al. | 89/1.816 |
| 4,318,342 | 3/1982 | Chandler | 89/6.5 |
| 4,444,087 | 4/1984 | Hunter et al. | 89/1.802 |
| 4,495,851 | 1/1985 | Koerner et al. | 89/6.5 |
| 4,649,796 | 3/1987 | Schmidt | 89/6.5 |
| 5,160,801 | 11/1992 | Andersen et al. | 89/6 |

FOREIGN PATENT DOCUMENTS 2431673 2/1980 France .

*Primary Examiner*—Charles T. Jordan
*Assistant Examiner*—Christopher K. Montgomery
*Attorney, Agent, or Firm*—Marshall, O'Toole, Gerstein, Murray & Borun

[57] ABSTRACT

Container (1) for packaging an object (2) provided with a radio frequency transmission device.

According to the invention, this container is noteworthy:

in that it includes a removable element (5) capable of blanking off an aperture of said container (1) and bearing, on the one hand, at least one radio frequency antenna and, on the other hand, at least one coaxial connector, said antenna and said coaxial connector being linked electrically to one another;

and in that, when said removable element (5) is in position blanking off said aperture, said coaxial connector is accessible from outside said container (1), while said antenna is internal to said container and is capable of being coupled in radio frequency terms with said radio frequency transmission device of said object (2) packaged in said container (1).

9 Claims, 3 Drawing Sheets

CONTAINER FOR PACKAGING AN OBJECT PROVIDED WITH A RADIO FREQUENCY TRANSMISSION DEVICE AND REMOVABLE ELEMENT FOR SUCH A CONTAINER

The present invention relates to a container for packaging an object provided with a radio frequency transmission device and a removable element for such a container.

Although said object may be anything, the present invention applies most particularly to the case in which said object is a missile. It will be set out below in relation to such an object.

It is known that many missiles are in radio frequency contact with an external monitoring and/or command post and, for that purpose, possess one or more radio frequency transmission devices. It is known moreover that it is common for such missiles to be packaged in a container while they are in storage or in transport, or even awaiting firing.

When it is packaged in its packaging, a missile must be able to communicate with an external command post, either to transmit information such as remote experimentation or checking measurements before firing, or to receive information, such as fire command, trajectory to be followed, remote destruction command, etc. To this end, it is natural that the radio frequency transmission device with which said missile is provided is used.

However, difficulties are encountered due to the fact that the walls of said container strongly, if not completely, attenuate the radio frequency waves.

The object of the present invention is to remedy these drawbacks.

To this end, according to the invention, the container for packaging an object provided with a radio frequency transmission device is noteworthy:

in that it includes a removable element capable of blanking off an aperture of said container and bearing, on the one hand, at least one radio frequency antenna, and, on the other hand, at least one coaxial connector, said antenna and said coaxial connector being linked electrically to one another;

and in that, when said removable element is in position blanking off said aperture, said coaxial connector is accessible from outside said container, while said antenna is internal to said container and is capable of being coupled in radio frequency terms with said radio frequency transmission device of said object packaged in said container.

Thus, by means of said coaxial connector and of an appropriate coaxial cable, any external command post can be in radio frequency contact with the radio frequency transmission device linked to said object (missile), so as to exchange information, said radio frequency antenna of the removable element providing the link with said radio frequency transmission device.

It will be noted that, due to the fact that said element is removable, several interchangeable removable elements may be provided, each specifically adapted to a particular missile and/or to a particular phase of the life of a missile (experimentation, development, storage, awaiting firing, etc.). Thus it is possible to use a single type of container for different missiles and/or during different phases of the life of the missiles. Thus, economies in the costs of the containers result therefrom. Moreover, said removable elements can be manufactured and developed, independently of the containers, which is a useful feature.

The container in accordance with the present invention may moreover include a simple stopper, capable of taking the place of said removable element in said aperture, during periods when radio frequency links are not necessary.

Said aperture may be any already existing aperture on the container. However, preferably, the aperture intended to accommodate said removable element and/or said stopper) is specifically formed for said removable element. Advantageously, it is produced in the upper wall of said container.

Thus, the present invention moreover relates to a removable element for blanking off an aperture of a container intended for packaging an object provided with a radio frequency transmission device. Such a removable element is noteworthy in that it bears, on the one hand, at least one radio frequency antenna and, on the other hand, at least one coaxial connector, said antenna and said coaxial connector being linked electrically to one another in such a way that, when said removable element is in position blanking off said aperture, said coaxial connector is accessible from outside said container, while said antenna is internal to said container and is capable of being coupled in radio frequency terms with said radio frequency transmission device of said object packaged in said container.

In one preferred embodiment, said removable element includes a blanking plate, capable of blanking off said aperture and provided with said coaxial connector which passes through it, and a panel, integral with said blanking plate and bearing said radio frequency antenna, this panel being capable of passing through said aperture, so as to be able to be inserted within said container, when the blanking plate is put in place on said aperture, or to be withdrawn therefrom, when said blanking plate is disengaged from said aperture.

Preferably, so that said panel is spaced away from the inner face of the wall of said container in position of blanking off said removable element, said blanking plate is cylindrical and said panel is integral with the inner end face of said blanking plate. It will be noted moreover that it is thus possible to house said coaxial connector within said blanking plate, without it projecting outwards. Said coaxial connector then passes through a transverse wall of said cylindrical blanking plate and is fixed to said wall.

Advantageously, said panel is arranged radially with respect to said blanking plate and said antenna is arranged on the face of said panel intended, in position blanking off said removable element, to be facing said object. The other, opposite face of said panel may bear the circuit of said antenna.

It is advantageous for said removable element to include a plurality of radio frequency antennae each corresponding to a specific radio frequency transmission (telemetry, remote destruction, remote trajectory plotting, etc.) and an equal number of coaxial connectors, associated respectively with said antennae. These coaxial connectors may be of different dimensions. In this case, the transverse wall of said cylindrical blanking plate on which said coaxial connectors are fixed may not be flat, but, in contrast, have different levels, so as best to house said coaxial connectors in said blanking plate.

The figures of the attached drawing will give a good understanding of how the invention can be produced. In these figures, identical references designate similar elements.

FIG. 1 diagramatically illustrates a container in accordance with the present invention, equipped with a removable element also in accordance with the present invention.

Figure 1:
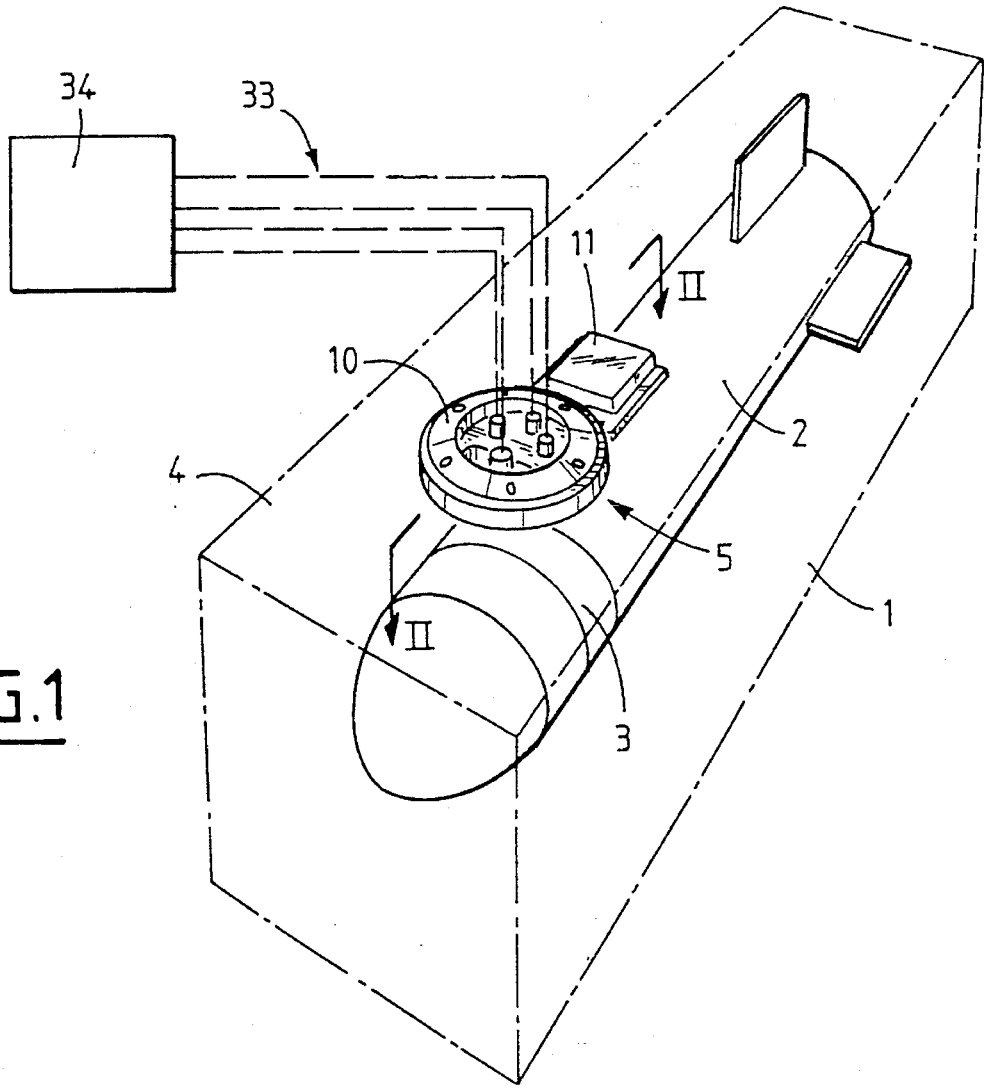

The container 1, shown diagrammatically in dots and dashes in FIG. 1, encloses a missile 2 equipped with a radio frequency transmission device, only the antenna or antennae 3 of which has or have been represented.

On one wall 4 of said container 1, for example the upper wall, a removable element 5 is fixed.

Figure 2:
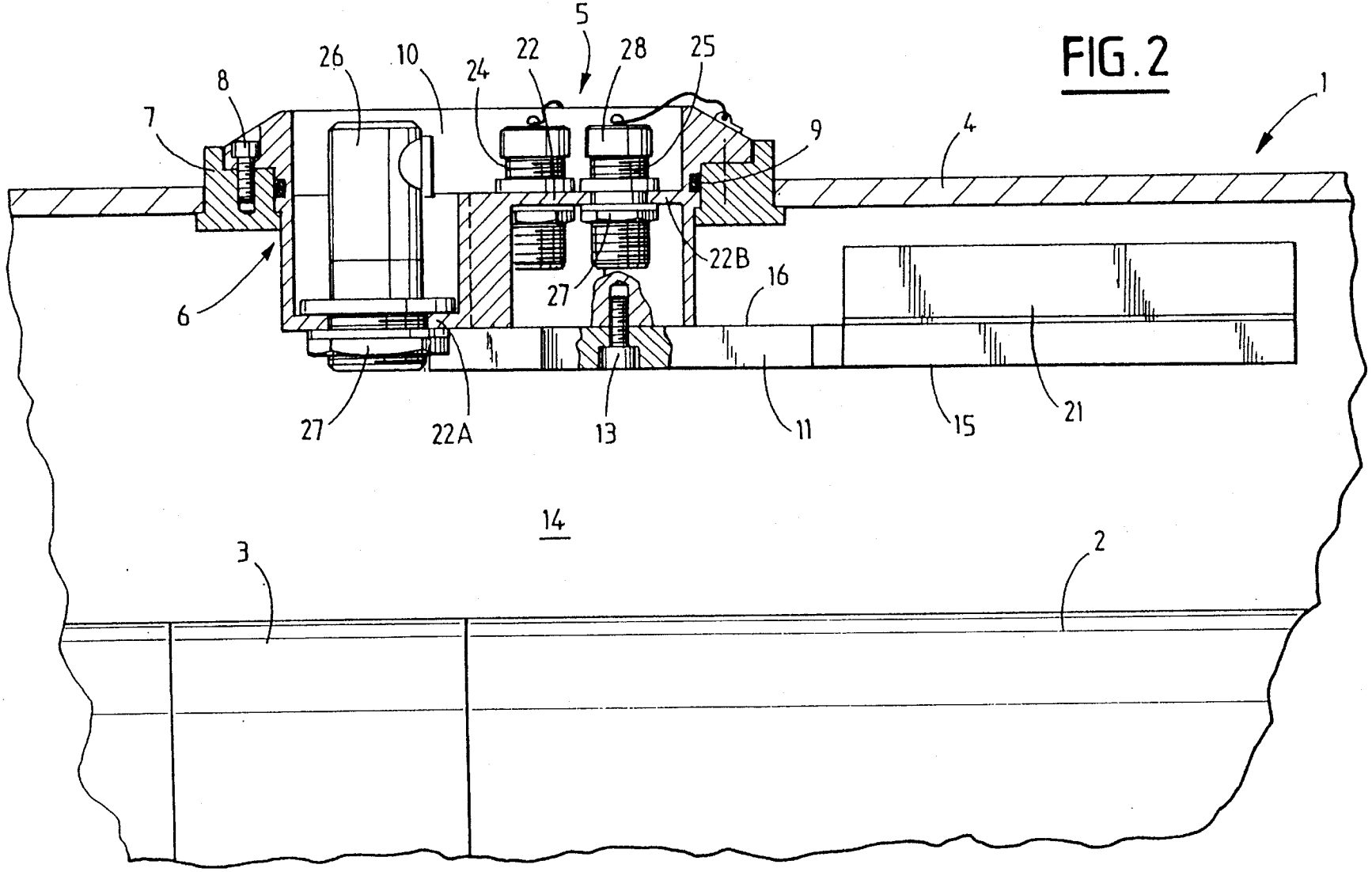
FIG. 2 is a partial section along line II—II of the container of FIG. 1, showing said removable element in section shown on a wall of said container.

To this end, said wall 4 is pierced by an aperture 6, edged, for example, with a flange 7, and onto which said removable element 5 can be fixed, for example by means of screws 8 (see FIG. 2). A seal 9 ensures leaktightness of this fixing.

Figure 3:
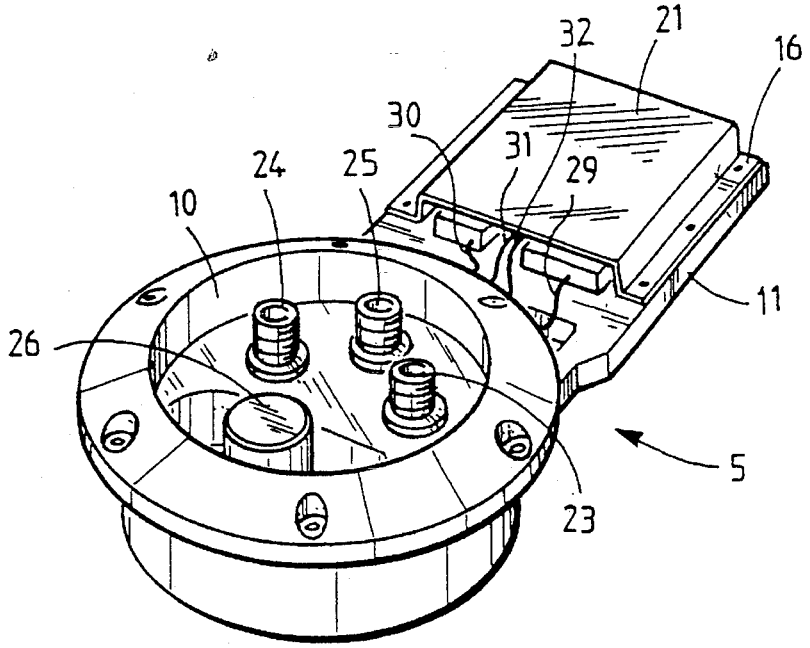
FIG. 3 is a view in perspective of the top of the removable element in accordance with the invention.
Figure 4:
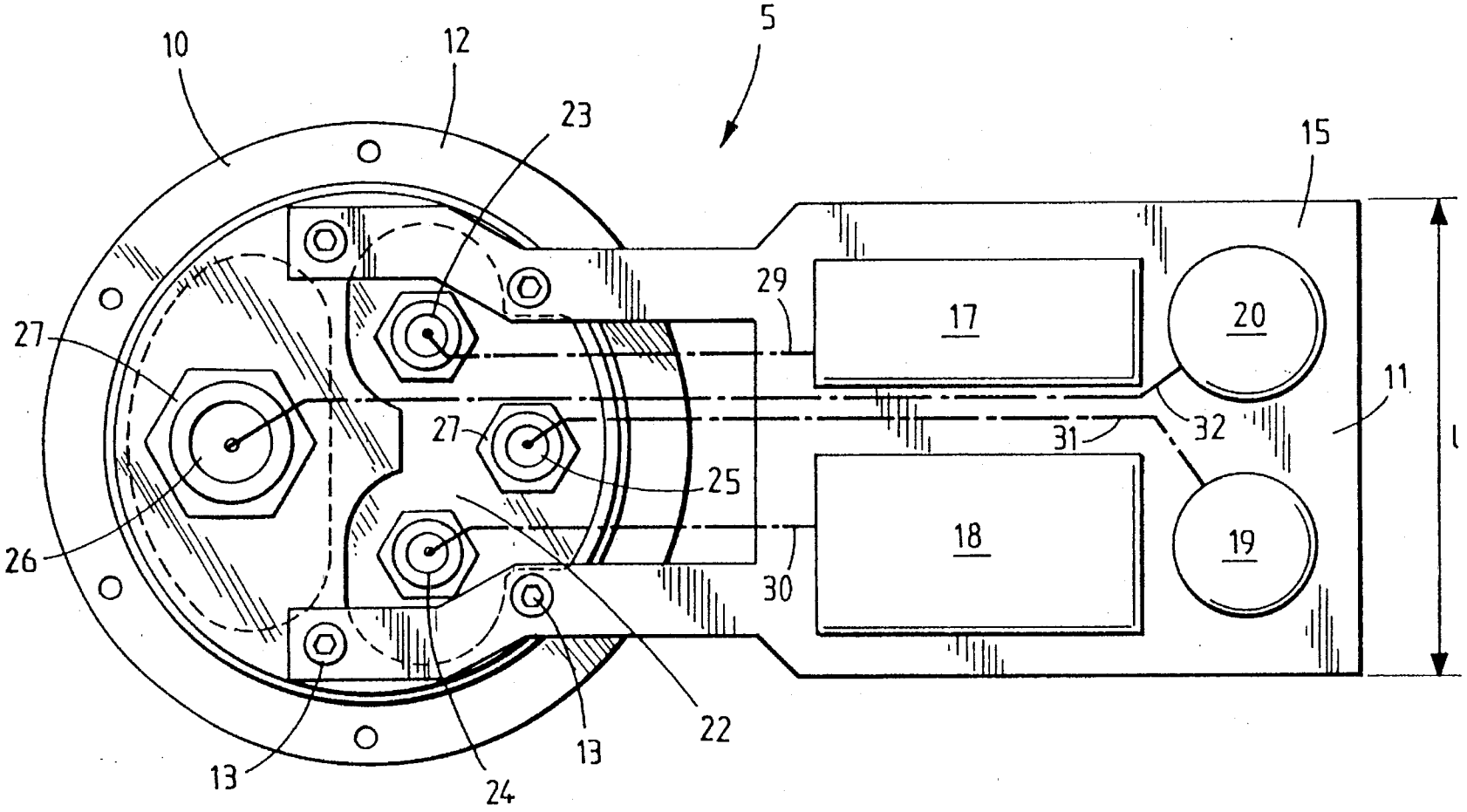
FIG. 4 is a view of said removable element from below.

As FIGS. 2, 3 and 4 show, said removable element 5 consists of a cylindrical blanking plate 10 intended to interact with the flange 7 so as to blank off said aperture 6, and of a projecting radial panel 11, fixed to the inner end face 12 of said blanking plate 10, for example by means of screws 13. The width 1 of said radial panel 11 is smaller than the diameter of the aperture 6, so as to be able to pass through said aperture 6 so as to be introduced to the inside 14 of the container 1, or to be withdrawn therefrom.

When the element 5 is thus put in place on the container 1 (see FIG. 2), said panel 11 is offset with respect to the aperture 6, one of its faces 15 being turned towards the inside 14 of said container 1, and thus towards the missile 2, and the other of its faces 16 being turned towards the inner face of the wall 4.

On the face 15 of the panel 11, radio frequency antennae 17, 18, 19 and 20 are arranged, while, on the face 16 of said panel 11, the circuits of said antennae are arranged, protected by a cap 21.

Moreover, in the blanking plate 10, a transverse wall 22 is provided, onto which coaxial through-plugs 23, 24, 25 and 26 are fixed.

Possibly, in order to be able to accommodate coaxial plugs of different dimensions in the cylindrical blanking plate 10, the transverse wall 22 is not flat, but includes steps. In the example represented, on the drawings, it can be seen that the coaxial plug 26 is larger than the coaxial plugs 23, 24 and 25, and that the part 22A of the wall 22 on which it is fixed is deeper than the part 22B on which the coaxial plugs 23, 24 and 25 are fixed.

In a known way, the coaxial through-plugs 23 to 26 are fixed by means of clamping bolts 27, interacting with their threaded body. Possibly, removable stoppers 28 are provided in order to blank off the outer ends of the coaxial plugs 23 to 26.

Moreover, coaxial links 29 to 32 (not represented in FIG. 2, but partially visible in FIG. 3, and illustrated in FIG. 4 only by broken lines for the sake of clarity in the drawing) link each of the electrodes 17 to 20 to the corresponding coaxial plug 23 to 26.

Hence, when the removable element 5 is put in place on the container 1, its blanking plate 10 blanks off the aperture 6 and the antennae 17 to 20 are turned towards the missile 2. Moreover, the coaxial through-plugs 23 to 26 are accessible from the outside and can thus be linked, via coaxial cables 33 (represented only in dashed lines in FIG. 1), to any radio frequency sending and/or receiving set 34, external to said container 1.

This results in it being possible to set up radio frequency links between the radio frequency transmission device carried by the missile 2 and said external set 34, by means of the coaxial cables 33, of the coaxial plugs 23 to 26, of the coaxial links 29 to 32 and of the radio frequency coupling between the antennae 17 to 20 and the antennae 3, within the container 1.

Needless to say, due to the radio frequency coupling between the antennae 17 to 20 and the antennae 3, the removable element 5 is specific to the radio frequency transmission device carried by the missile 2. However, it will be noted that a removable element 5 can be used, whatever the container 1 and the missile 2, provided that this element 5 can interact with the transmission device carried by said missile. Likewise, if several removable elements 5 are provided, capable of being mounted interchangeably on a container 1, it is possible either to use said container to package several different types of missiles 2, whose transmission devices are matched respectively to said removable elements 5, or to set up different specific radio frequency links between the same missile 2 and the set 34.

Possibly, when no radio frequency link is wanted between the missile 2 and the set 34, a simple stopper (not represented) can be provided, capable of blanking off the aperture 6 of the container 1 so as to replace the blanking plate 10, after removal of the removable element 5 or before the latter is put in place.

Moreover, it will be noted that the aperture 6 can be specially provided on the container 1 to accommodate the removable element 5, or also that the blanking plate 10 of said removable element 5 may be adapted to be able to blank off an aperture 6 already existing on said container 1 for another use.

What is claimed is:

1. A removable element for blanking off an aperture of a container intended for packaging an object provided with a radio frequency transmission device, which bears at least one radio frequency antenna and at least one coaxial connector, said antenna and said coaxial connector being linked electrically to one another in such a way that, when said removable element is in position blanking off said aperture, said coaxial connector is accessible from outside said container, while said antenna is internal to said container and is capable of being coupled in radio frequency terms with said radio frequency transmission device of said object packaged in said container, said removable element having a blanking plate, capable of blanking off said aperture and provided with said coaxial connector which passes through said aperture, and a panel integral with said blanking plate and bearing said radio frequency antenna, said panel being capable of passing through said aperture.

2. The removable element as claimed in claim 1, wherein said blanking plate is cylindrical and has an inner end face and wherein said panel is integral with said inner end face of said blanking plate.

3. The removable element as claimed in claim 1, wherein said panel is arranged radially with respect to said blanking plate.

4. The removable element as claimed in claim 1, wherein said panel has a first face which faces said object when said removable element is positioned to blank off said aperture, said antenna being arranged on said first face.

5. The removable element as claimed in claim 4, wherein said panel has a second face opposite said first face and wherein said panel has a circuit associated with said antenna, said circuit being carded on said second face.

6. A removable element for blanking off an aperture of a container intended for packaging an object provided with a radio frequency transmission device, which bears at least one radio frequency antenna and at least one coaxial connector, said antenna and said coaxial connector being linked electrically to one another in such a way that, when said removable element is in position blanking off said aperture, said coaxial connector is accessible from outside said container, while said antenna is internal to said container and is capable of being coupled in radio frequency terms with said radio frequency transmission device of said object packaged in said container, said removable element having a plurality of radio frequency antennae each corresponding to a specific radio frequency transmission and an equal number of coaxial connectors, associated respectively with the antennae.

7. A removable element for blanking off an aperture of a container intended for packaging an object provided with a radio transmission device, said removable element comprising:

an obturator, capable of blanking off said aperture and provided with a coaxial connector; and a radio antenna, associated with said obturator and capable of passing through said aperture;

said radio antenna and said coaxial connector being linked electrically to one another in such a way that, when said removable element is in position blanking off said aperture, said coaxial connector is accessible from outside said container, while said antenna is internal to said container and is capable of being radio-coupled with said radio transmission device of said object packaged in said container.

8. The removable element as claimed in claim 7, wherein said obturator is provided with a panel integral with said obturator and bearing said radio antenna, said panel being capable of passing through said aperture.

9. An apparatus, comprising:

a container for packaging an object provided with a radio transmission device, said container having an interior portion at least partially enclosed by a wall and an aperture formed through a portion of said wall, said aperture passing completely through said wall portion; and a removable element for blanking off said aperture of said container, said interior portion of said container being exposed to the ambient atmosphere outside said container via said aperture when said removable element is not disposed in said aperture, said removable element comprising:

a blanking element, capable of blanking off said aperture;

a coaxial connector associated with said blanking element; and a radio antenna associated with said blanking element;

said radio antenna and said coaxial connector being linked electrically to one another in such a way that, when said removable element is in position blanking off said aperture, said coaxial connector is accessible from outside said container, while said antenna is internal to said container and is capable of being radio-coupled with said radio transmission device of said object packaged in said container.

* * * * *

UNITED STATES PATENT AND TRADEMARK OFFICE

CERTIFICATE OF CORRECTION

PATENT NO. : 5,458,042

DATED : October 17, 1995

INVENTOR(S) : Philippe Cante

It is certified that error appears in the above-indentified patent and that said Letters Patent is hereby corrected as shown below:

Column 4, Line 59, "carded" should be --carried--

Signed and Sealed this

Fifth Day of March, 1996

*Attest:*

Bruce Lehman

BRUCE LEHMAN

*Attesting Officer*

*Commissioner of Patents and Trademarks*